US007614257B2

(12) United States Patent
Araki et al.

(10) Patent No.: US 7,614,257 B2
(45) Date of Patent: Nov. 10, 2009

(54) SOCK

(75) Inventors: Takahiro Araki, Nara (JP); Chika Watatani, Nara (JP)

(73) Assignee: Okamoto Corporation, Nara (JP)

( * ) Notice: Subject to any disclaimer, the term of this patent is extended or adjusted under 35 U.S.C. 154(b) by 0 days.

(21) Appl. No.: 12/246,002

(22) Filed: Oct. 6, 2008

(65) Prior Publication Data

US 2009/0095026 A1 Apr. 16, 2009

(51) Int. Cl.
*A41B 11/00* (2006.01)

(52) U.S. Cl. ..... 66/185

(58) Field of Classification Search ..... 66/185, 66/178 R, 182, 183, 184, 186; 2/239, 241
See application file for complete search history.

(56) References Cited

U.S. PATENT DOCUMENTS 4,104,892 A * 8/1978 Thorneburg ..... 66/185
4,732,015 A * 3/1988 Abrams et al. ..... 66/172 E
4,898,007 A * 2/1990 Dahlgren ..... 66/185
5,603,232 A * 2/1997 Throneburg ..... 66/185
5,708,985 A * 1/1998 Ogden ..... 66/178 R
D392,795 S * 3/1998 Ogden ..... D2/980
5,791,163 A * 8/1998 Throneburg ..... 66/178 R
6,324,874 B2 * 12/2001 Fujimoto ..... 66/185
6,341,505 B1 * 1/2002 Dahlgren ..... 66/185
6,708,348 B1 * 3/2004 Romay ..... 2/239

FOREIGN PATENT DOCUMENTS

JP 2001-295104 A 10/2001
JP 3113253 U 9/2005
JP 3121397 U 5/2006

* cited by examiner

*Primary Examiner*—Danny Worrell
(74) *Attorney, Agent, or Firm*—Brinks Hofer Gilson & Lione

(57) ABSTRACT

A sock includes an air escape route that allows humid air to be expelled to the outside of a shoe. The sock may include a first rib area provided in a ground-touching area of a sole portion of the sock, the ribs being formed in a desired direction. A second rib area, in which ribs are formed in a wale direction, may also be provided in an instep portion of the sock. The ribs of the first and second rib areas may be knitted with alternating knitted pile and knitted mesh fabric. Humid air collecting in areas that do not touch the ground passes through the concave portions of the ribs of the first rib area, and is impelled toward the instep side. Air flowing to the instep side of the sock via the first rib area is expelled to the outside of the shoe via the second rib area.

11 Claims, 7 Drawing Sheets

SOCK

RELATED APPLICATIONS

This application claims priority under 35 U.S.C. §119 to Japanese Patent Application No. JP2007-264871 filed Oct. 10, 2007, the entire content of which is hereby incorporated by reference.

TECHNICAL FIELD

The present invention relates to a sock having the advantageous effects of greater functionality in the ventilation of air inside and outside of the sock, as well as suppressing increases in temperature and humidity within the sock to the greatest extent possible.

BACKGROUND ART

Socks are commercially available which employ materials with a high degree of water absorbability and rapid drying properties, as well as materials with a mesh structure, aiming to produce a sock with an internal environment as comfortable to the wearer as possible.

Heretofore, there has also been disclosed a sock with a plain knitted portion and a pile knitted portion disposed in a lattice configuration in the arch portion of the sock, with increased air permeability at specified areas of the sole portion.

However, due to the fact that the temperature of the entire sole rises during walking, there is the problem that the sock of Japanese Laid-Open Patent Application No. 2001-295104, which increases air permeability only in the arch portion, an area of the sole which does not touch the ground, cannot increase air permeability as fully as expected, simply because humid air is trapped inside the shoe.

A sock is disclosed in Japanese Utility Model Registration No. 3113253 in which a sock has a knitted structure with mesh knitting at the base portions of toes on the instep side and the sole side, and in the arch portion, and with pile knitting in the sole portion and the toe portion. However, the sock of Japanese Utility Model Registration No. 3113253 had improved air permeability primarily only at the base portions of toes and in the arch portion, which are areas of the sole which do not touch the ground. Therefore, there is the problem that sufficient ventilation cannot be achieved, even with the alternating mesh knitting and pile knitting being additionally disposed on the front of the ankle and on the instep portion, due to the fact that no provision was made for air to escape from the sock or from the shoe.

In Japanese Utility Model Registration No. 3121397 given below, there is disclosed a sock with a band with uneven configuration formed by varying the pile lengths provided at a uniform width on the outer surface of the sole portion, and with a plurality of uneven bands formed on the front side of the arch portion across the entire circumference of the foot from the sole to the instep.

However, in the case of the above-described sock of Japanese Utility Model Registration No. 3121397, there is also the problem that sufficient ventilation cannot be achieved, since no provision was made for humid air to escape from the sock or from the shoe. The steamy feeling is not eliminated, even if an uneven band is formed along the entire circumference of the foot from the sole to the instep, since the humid air circulates along this uneven band.

SUMMARY OF THE INVENTION

The problems to be solved are that, in the prior art sock, air permeability is improved only at certain positions on the sock, that no escape route for air is provided for humid air to escape from the shoe, and that it is impossible to introduce air from the outside of the shoe to the inside of the sock to increase ventilation.

In order to solve the above problems, the sock of the present invention is characterized in that a ground-touching area of a sole portion of a sock is provided with a first rib area where ribs are formed in a desired direction, being knitted with alternating knitted pile fabric and knitted mesh fabric, and an instep portion is provided with a second rib area where ribs are formed in the wale direction, being knitted with alternating knitted pile fabric and knitted mesh fabric.

In accordance with the present invention, the ground-touching area of a sole portion of a sock is provided with the first rib area where knitted pile fabric and knitted mesh fabric are alternately knitted, so that while walking, the humid air which collects in areas which do not touch the ground, such as the base portions of toes and the arch portion, passes through the concave portions of ribs of the first rib area, and is impelled toward the instep side, thereby promoting air permeability. In addition, the instep portion is provided with the second rib area where the ribs are formed in the wale direction, being knitted with alternating knitted pile fabric and knitted mesh fabric, so that air which flows to the instep side via the first rib area is expelled to the outside of the shoe via the second rib area. Moreover, ventilation inside the sock can be enhanced, since air from outside of the shoe is introduced into the sock via a route opposite to that described above.

PREFERRED EMBODIMENTS

The object of the present invention is not to increase air permeability of only specified areas of a sock, but to expel to the outside of a shoe humid air that stays primarily in portions of the sock which do not touch the ground, and to introduce air from outside of the shoe into the sock. This is achieved by providing to the ground-touching area of the sole portion of the sock a first rib area where ribs are formed in a desired direction, being knitted with alternating knitted pile fabric and knitted mesh fabric, and providing to the instep portion a second rib area where ribs are formed in a wale direction, being knitted with alternating knitted pile fabric and knitted mesh fabric.

When a knitted pile fabric and a knitted mesh fabric are knit so as to alternate with each other, the thickness of the pile-knit fabric becomes more bulky, resulting in a state in which a convex portion formed by the knitted pile fabric and a concave portion formed by the knitted mesh fabric are disposed so as to alternate with each other. In the present invention, the state in which this knitted pile fabric (convex portion) and the knitted mesh fabric (concave portion) are disposed in alternating fashion is referred to as a "rib."

Figure 5:
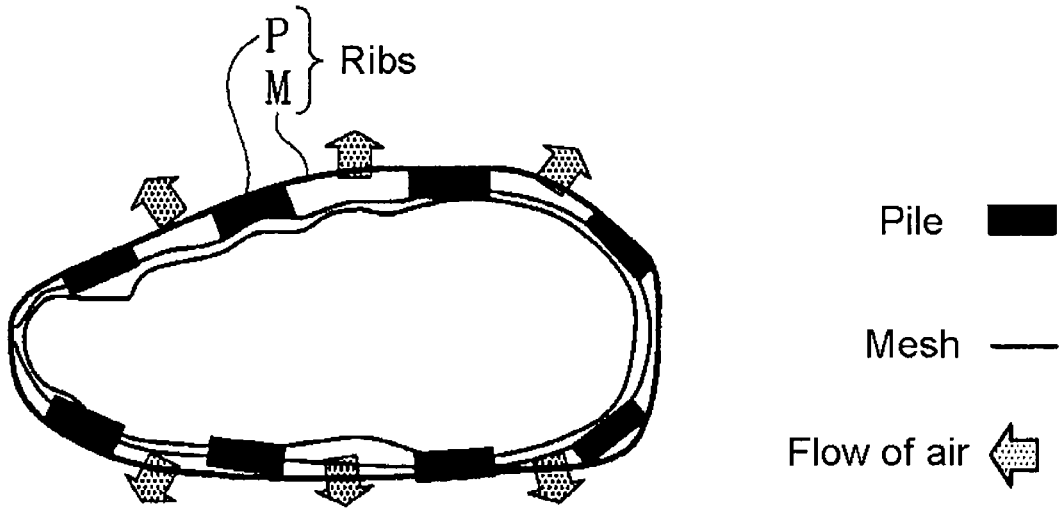
FIG. 5 is a schematic diagram showing a vertical sectional view of a foot on which a sock of the present invention is worn.

FIG. 5 is a schematic diagram with a vertical sectional view of a foot portion showing a condition in which a sock of the present invention is worn. As shown in FIG. 5, in the sock of the present invention, the inner surface of the sock is provided with ribs with a convex portion formed by a knitted pile fabric P and a concave portion formed by a mesh knitted portion M disposed so as to alternate with each other, so that the concave portions formed by the knitted mesh fabric M form passageways for expelling humid air to the outside of the shoe.

Figure 6:
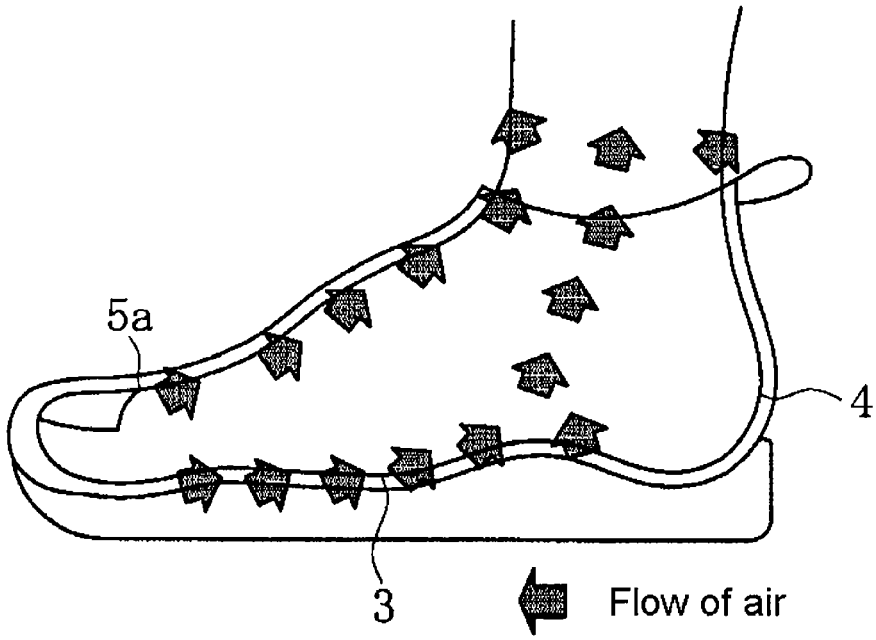
FIG. 6 is a drawing showing the flow of air when a sock of the present invention is worn.

In the present invention, it is preferable for the first rib area to be provided only at the portions of the base of the big toe, the base of the little toe, and the outside of the center of the sole within the ground-touching area of the sole. The ground-touching area of the sole portion also includes a heel portion, but as shown in FIG. 6, a heel portion 4 is an area where force is initially applied when walking, so the ventilation ratio becomes more favorable when an air passageway is provided by the concave portions of the knitted mesh fabric such that humid air which collects in areas which do not touch the ground, such as the base portions 5*a* of toes and the arch portion 3 where humid air most readily collects in the sock, is delivered to the instep side from positions forward the heel portion 4, such as the portions of the base of the big toe, the base of the little toe, and the outside of the center of the sole. It is also possible to provide a first rib area to the heel portion 4, but there is a possibility that the rib structure might collapse, since a strong force is applied to the heel portion 4 when walking.

It should be noted that in the present invention, "ground-touching area" of the sole portion refers to parts of the sole which make contact with a floor surface when standing upright in a natural manner on a flat floor surface, and "area which does not touch the ground" refers to an area of the sole other than a "ground-touching area."

As discussed above, humid air collects in areas which do not touch the ground, such as the base portions of toes and the arch portion. Therefore, in order to improve air permeability in the sole portion of the sock, it is effective to provide as many air passageways as possible connecting the base portions of toes and the arch portion. In the sock of the present invention, it is possible to form all of the ribs in the first rib area in the wale direction, and in this case, the passage of air is promoted between the base portion of the big toe and the arch portion, but this results in the passage of air being blocked at the base of the little toe.

Accordingly, in the present invention, it is more preferable for the ribs of the first rib area to be formed in the wale direction at the base portion of the big toe, and to be formed diagonally from the arch portion toward the outer side of the little toe at the base portion of the little toe. This promotes the passage of air in both directions between the arch portion and the base portions of toes, including not only at the base portion of the big toe, but also at the base portion of the little toe, thereby making it possible to more efficiently deliver air to the instep side of the foot.

Furthermore, when employing a structure such as described above, it is further preferable to provide to the outside of the center of the sole a portion in which ribs are formed in the course direction. This is because humid air which collects in the arch portion is able to pass through the concave portions of the ribs provided to the outside portion of the center of the sole portion, thereby escaping toward the outside of the foot.

For the same reason described above, the first rib area may be provided at the portions of the base of the big toe, the base of the little toe, and at the outside of the center of the sole, so that the ribs are formed radially, as viewed from the position of the arch portion. If the ribs are disposed radially, air permeability is promoted in both directions between the arch portion and the base portions of the toes, including not only the base portion of the big toe, but also the base portion of the little toe. In addition, humid air which collects in the arch portion is able to pass through the concave portions of the ribs provided to the outside portion of the center of the sole portion, thereby escaping to the outside of the foot.

In the present invention, a convex portion formed from knitted pile fabric and a concave portion formed from knitted mesh fabric are provided alternating with each other, and there are no particular limitations on the widths of these convex and concave portions, which can be suitably set according to considerations such as the ventilation performance, curvature of the foot, wearing comfort, and cushioning effect.

From the standpoint of a balance between air permeability performance and cushioning effect, it is preferable for the first rib area and the second rib area to both have a convex portion formed from knitted pile fabric and a concave portion formed from knitted mesh fabric, with an alternating knitting structure within a range of 4-8 wales. Furthermore, from the standpoint of sock design, it is preferable for the convex portions and the concave portions of the ribs in the first rib area and the second rib area to be disposed at equal intervals.

Moreover, when employing a structure such as described above, it is most preferable that the first rib area has a knitting structure such that the convex portions formed from knitted pile fabric and the concave portions formed from knitted mesh fabric alternate every 4 wales, and the second rib area has a knitting structure such that the convex portions formed from knitted pile fabric and the concave portions formed from knitted mesh fabric alternate every 8 wales. Since the first rib area undergoes compression by the wearer's weight, it should be structured within the favorable range described above, using the lower limit value of 4 wales, so that the concave portions will not collapse. Since the second rib area does not undergo compression by the wearer's weight, the ventilation performance is improved, using the upper limit value of 8 wales.

In the present invention, it is preferable that the second rib area is extended in the wale direction from the instep area to at least a portion of the leg area. The second rib area serves the function of expelling humid air to outside of the shoe, and by extending it to at least a portion of the leg area, the humid air can be more reliably expelled to outside of the shoe.

It should be noted that areas in the leg portion where a second rib area is not provided can be knit with support knitting, tuck knitting, float knitting, ridge knitting, for example, using a fabric inlaid with rubber, to make it difficult for the sock to slip down. The second rib area can also be provided to the entire area of the leg portion.

In the present invention, the ribs of the first rib area and the second rib area can be formed so as to produce concave and convex portions on the inner surface of the sock, and they can also be formed so as to produce concave and convex portions on the outer surface. If they are formed on the inner surface, air passageways resulting from the concave portions of knitted pile fabric are formed between the sock and the skin of the foot, as shown in FIG. 5. If they are formed on the outer surface, air passageways are formed by the concave portions of the knitted pile fabric between the sock and the shoe.

However, from the standpoint of making it possible for the wearer to feel the benefit of air permeability directly on the skin of the foot, it is more suitable for air passageways of the concave portions of the knitted pile fabric to be formed on the inner surface of the sock. Therefore, in the present invention, it is preferable for the ribs provided in the first rib area and the second rib area to be formed so that concave and convex portions are disposed on the inner surface of the sock.

In the present invention, it is preferable that the first rib area and the second rib area are knitted from one or two or more materials selected from polyester, acrylic, wool, rayon, and cotton material with a high degree of water absorbability and rapid drying properties. Sweat is more rapidly absorbed and dried when using a material with a high degree of water absorbability and rapid drying properties, and the air permeability effect is sustained by the knitted mesh fabric.

In the present invention, it is preferable that the heel portion and the toe portion are knitted with a knitted pile fabric, and the arch portion is knitted with a knitted mesh fabric. The design aims to increase the shock-absorbing capacity by using pile knitting in the heel portion which is subjected to the greatest impact when it makes contact with the ground during walking, and also to ensure propulsive capacity by using pile knitting in the toe portion where force is exerted when the foot kicks the ground to generate thrust for walking. Furthermore, the use of mesh knitting in the arch portion improves air permeability of the arch portion where humid air readily collects.

In the present invention, it is also preferable to provide a third rib area in which ribs are formed in the wale direction, with pile-knit fabric and mesh-knit fabric knitted in alternating fashion at a position above the heel portion. This makes it possible to increase air permeability using air from outside of the shoe on the back side of the leg portion, in addition to the ventilation function produced by the first rib area and the second rib area.

Examples

Figure 1:
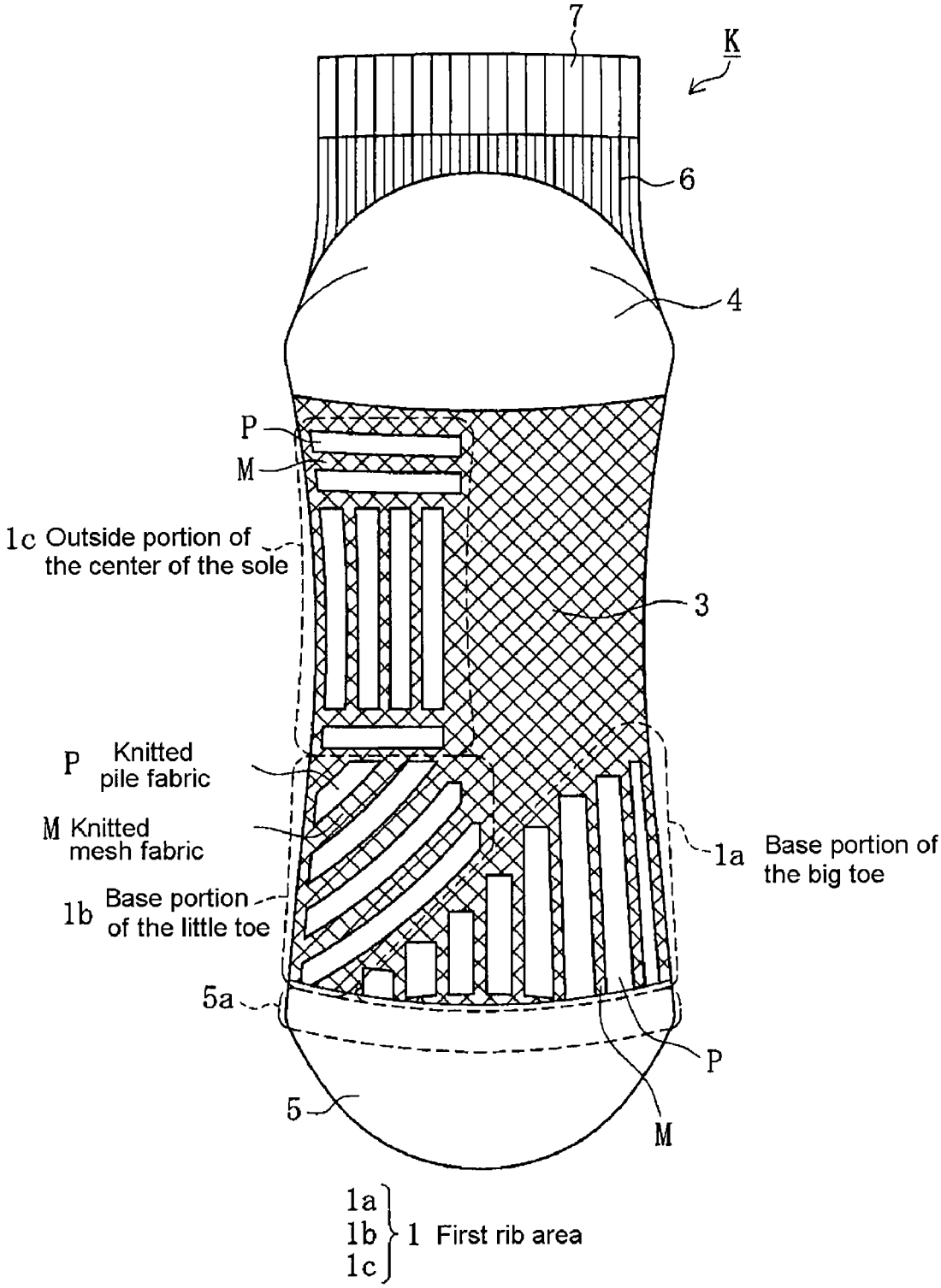
FIG. 1 is a drawing illustrating a sock of the present invention for use on the left foot, as viewed from the side of the sole portion.
Figure 2:
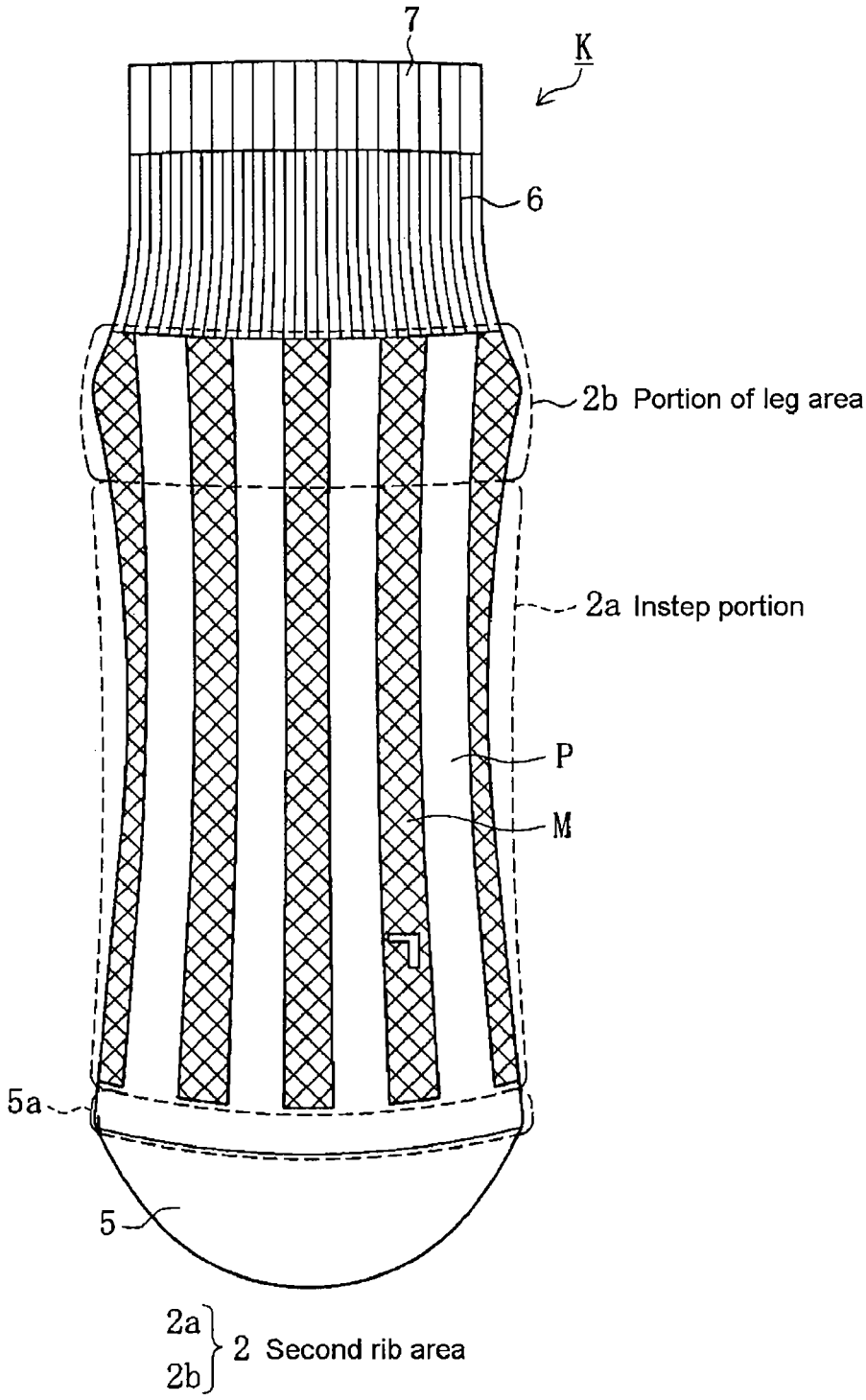
FIG. 2 is a drawing illustrating the sock of FIG. 1 as viewed from the side of the instep portion.
Figure 3:
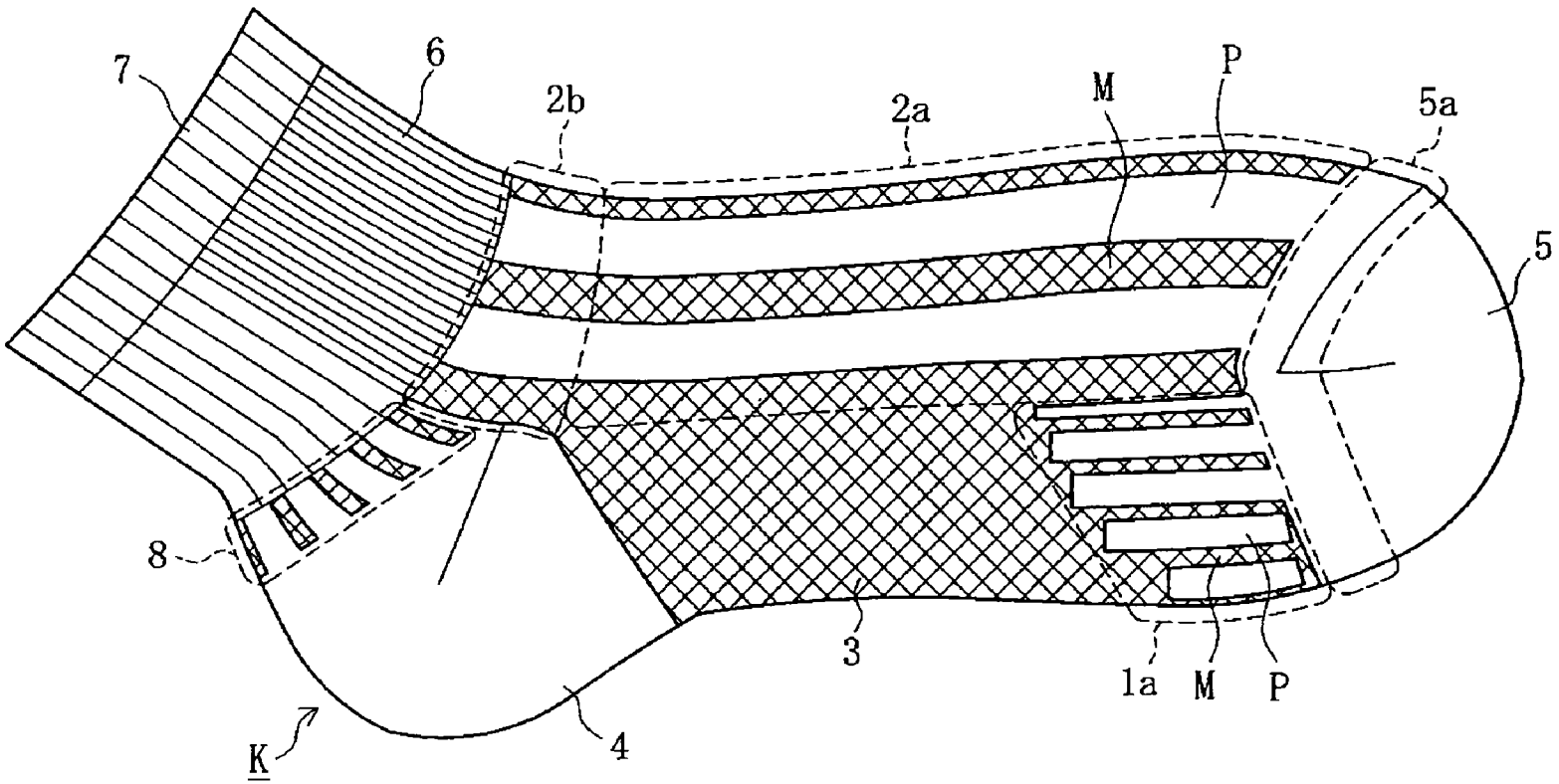
FIG. 3 is a drawing illustrating the sock of FIG. 1 as viewed from the side of the big toe.
Figure 4:
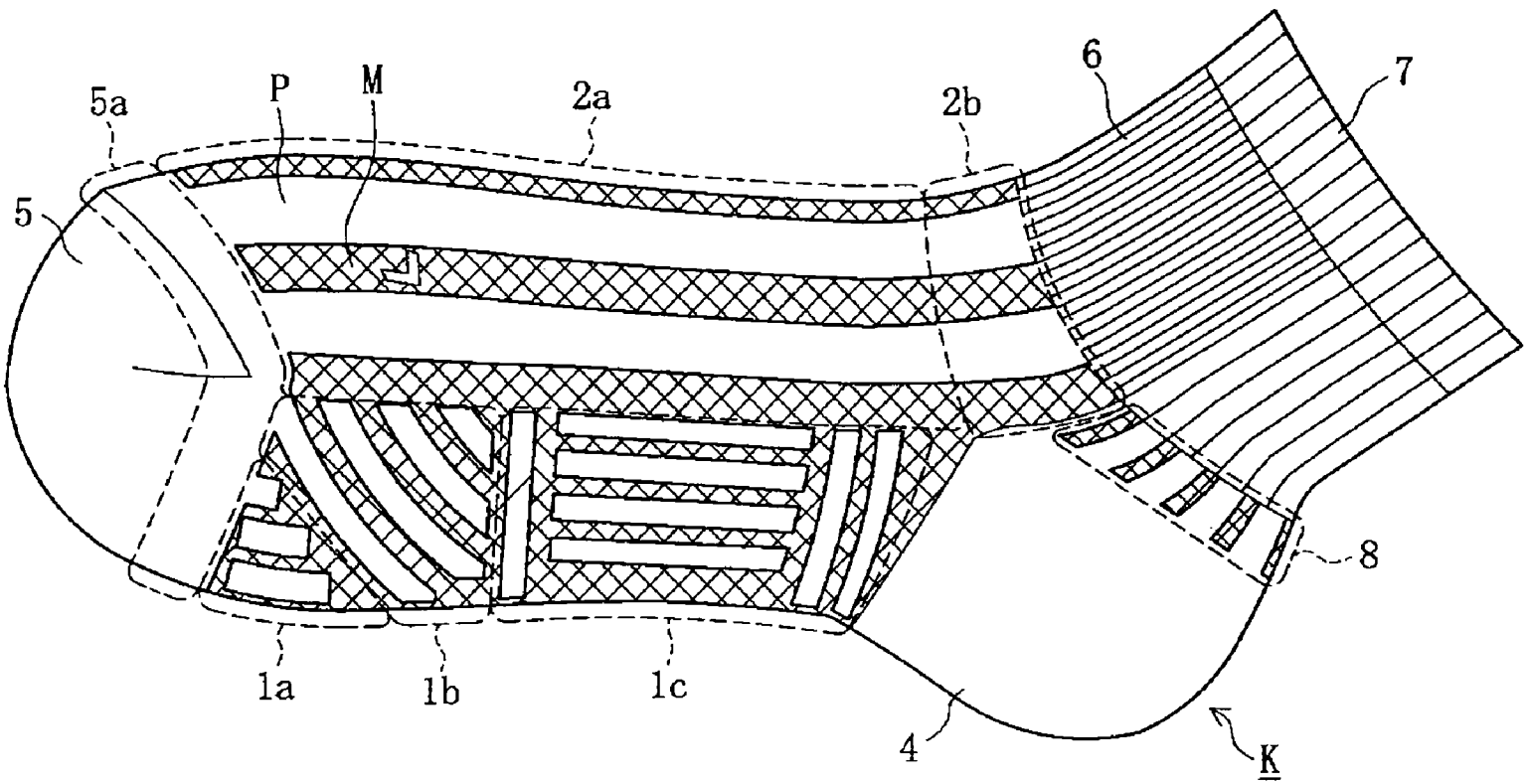
FIG. 4 is a drawing illustrating the sock of FIG. 1 as viewed from the side of the little toe.

The sock of the present invention is described in further detail with examples below. FIG. 1 is a drawing illustrating a sock of the present invention for use on the left foot, as viewed from the plane of the sole portion. FIG. 2 is a drawing illustrating the sock of FIG. 1 as viewed from the plane of the instep portion. FIG. 3 is a drawing illustrating the sock of FIG. 1 as viewed from the plane of the big toe. FIG. 4 is a drawing illustrating the sock of FIG. 1 as viewed from the plane of the little toe.

Sock K of this example uses a cotton/polyester blend (60% cotton/40% polyester) with a high degree of water absorbability and rapid drying properties. An ordinary knitting machine is used to knit with front yarns and back yarns. FTY, which has good knitting properties, is used for the back yarns. FTY is a fiber commonly used as a back yarn in socks, with nylon fibers or polyester fibers covering polyurethane fibers.

As shown in FIGS. 1-4, the sock K of this example has a first rib area 1 provided to the ground-touching areas of the sole portion of the sock K, with ribs formed in the desired directions and knitted with knitted pile fabric P and knitted mesh fabric M alternating with each other. Additionally, to an instep portion 2*a* is provided a second rib area 2 with ribs formed in the wale direction and knitted with knitted pile fabric P and knitted mesh fabric M alternating with each other. In FIG. 1, Reference Numeral 3 is an arch portion where humid air readily collects; 4 is a heel portion; 5 is a toe portion; 6 is an upper area of the leg portion; and 7 is an elastic holding member.

When the knitted pile fabric P and the knitted mesh fabric M are knitted so as to alternate with each other, the thickness of the knitted pile fabric P can be made bulky, thereby making it possible to form ribs with convex portions formed by the knitted pile fabric P and concave portions formed by the knitted mesh fabric M disposed so as to alternate with each other. In the present invention, concave portions formed by the knitted mesh fabric M are used as escape passageways for air, to expel humid air to outside of the shoe.

As shown in FIG. 1, the sock K of this example has the first rib area 1 provided only to the base portion of the big toe 1*a*, the base portion of the little toe 1*b*, and an outside portion of the center of the sole 1*c* within the ground-touching area of the sole, but it is not provided to the heel portion 4. Since the heel portion 4 is an area where force is initially applied when walking, it will therefore achieve higher ventilation effect to provide air passageways formed of the concave portions of the knitted mesh fabric such that humid air which collects in areas which do not touch the ground, such as the base portion 5*a* of toes and the arch portion 3 where humid air most readily collects in the sock, is delivered to the instep portion 2*a* from positions such as the base portion 1*a* of the big toe, the base portion 1*b* of the little toe, and the outside portion of the center of the sole 1*c* forward the heel portion 4.

Moreover, in the sock K of this example, the ribs of the first rib area 1 are formed in the wale direction at the base portion 1*a* of the big toe, and formed diagonally from the arch portion 3 in a direction facing the outer side of the little toe at the base portion 1*b* of the little toe.

The reason for such a structure is that in the sock of the present invention, although all of the ribs in the first rib area 1 can be formed in the wale direction, if the ribs are so formed, the mutual passage of air between the base portion 5*a* of toe and the arch portion 3 is promoted at the base portion 1*a* of the big toe, but the passage of air is blocked at the base portion 1*b* of the little toe. If the base portion 1*b* of the little toe has ribs formed diagonally from the arch portion 3 in a direction facing the outer side of the little toe, as in the sock K of this example, then ventilation is promoted even at the base portion of the little toe, and humid air can be more efficiently delivered to the instep portion 2*a*.

In addition, as shown in FIG. 1, the sock K of this example is provided with an area where ribs are formed in the course direction at both ends in the wale direction of the outside portion of the center of the sole 1*c*. This makes it possible for humid air which collects in the arch portion 3 to pass through the concave portions of the ribs provided to the outside portion of the center of the sole 1*c*, and escape toward outside of the foot.

In this example, the first rib area 1 shown in FIG. 1 has a knitting structure in which the convex portion formed by the knitted pile fabric P and the concave portion formed by the knitted mesh fabric M alternate with each other at 4 wale intervals. The second rib area 2 shown in FIG. 2, has a knitting structure in which the convex portion formed by the knitted pile fabric P and the concave portion formed by the knitted mesh fabric M alternate with each other at 8 wale intervals.

There are no particular limitations on the design of the width of the convex portions and the concave portions. However, based on the test results for measuring air permeability performance in a horizontal orientation described below, it has been determined that it is preferable for the first rib area and the second rib area to both have a knitting structure in which the convex areas formed by knitted pile fabric and the concave portions formed by knitted mesh fabric alternate with each other within a range of 4-8 wales, for the sake of a balance between air permeability performance and cushioning effect.

Since the first rib area 1 is subject to compression by the wearer's weight, it should be structured using 4 wales so that the concave portions will not collapse. Since the second rib area 2 is not subject to compression by the wearer's weight, the upper limit value of 8 wales is used, so as to enhance the function of ventilation to outside of the shoe.

FIG. 2 is a drawing illustrating the sock K of this example as viewed from the side of the instep portion 2*a*. In the drawing, the combined areas of both 2*b* and 6 are portions of the leg, but in this example, the second rib area 2 extends in the wale direction from the instep portion 2*a* to the leg area portion 2*b*. The second rib area 2 serves the function of expelling humid air trapped in the sole portion to outside of the shoe. However, extending the second rib area 2 up to at least a part of the leg area portion 2*b* makes it possible to more reliably expel humid air to outside of the shoe. The leg portion 6 which is not provided with a second rib area is knit with support knitting, to make it difficult for the sock K to slip down.

FIGS. 3-4 illustrate the sock K as viewed from the big toe and the little toe. In this example, the ribs provided to the first rib area 1 and the second area 2 are formed so as to produce concave and convex portions on the inner surface of the sock. Air passageways are formed between the sock and the skin of the foot, making it possible for the wearer to feel the benefit of air permeability directly on the skin of the foot.

This example is designed to increase the shock-absorbing capacity by using pile knitting in the heel portion 4 which is subjected to the greatest impact when it makes contact with the ground during walking, and also to ensure propulsive capacity by using pile knitting in the toe portion 5 where force is exerted when the foot kicks the ground to generate thrust for walking. Furthermore, the use of knitted mesh fabric in the arch portion 3, where humid air readily collects, makes it possible to expel humidity and heat from the arch portion 3 to the outside via the knitted mesh fabric.

Furthermore, as shown in FIGS. 3-4, in the sock K of this example, there is provided a third rib area 8 in which ribs are formed in the wale direction, with knitted pile fabric and knitted mesh fabric which are knitted in alternating fashion at a position above the heel portion 4. This makes it possible to increase ventilation on the back side of the leg portion, in addition to the ventilation function resulting from the first rib area and the second rib area.

Following is an explanation of the methods and results of tests performed to verify the advantageous effects of the sock of the present invention. The tests were performed on the five tests points: (a) Test to measure air permeability performance in the horizontal orientation; (b) Test to evaluate the in-shoe ventilation rate; (c) Tests to measure bacterial cell count and odor intensity after 8 hours of wearing; (d) In-shoe simulation test; and (e) Test to measure fabric air permeability.

(a) Test to Measure Air Permeability Performance in the Horizontal Orientation

The air permeability of knitted fabrics in the horizontal orientation was measured using a Frazier permeability tester, to evaluate variations in the in-shoe ventilation environment assumed to occur because of the sock.

1) Test Method

A test fabric was inserted into the specimen holder made from acrylic sheets, and the specimen holder with the inserted test fabric was placed vertically into a Frazier permeability tester. The permeability of the test fabric in the horizontal orientation was measured twice, and an average value was obtained.

Three comparative examples were prepared: a plain knitted sock (Comparative Example 1: Plain); a pile knitted sock (Comparative Example 2: Pile); and a mesh knitted sock (Comparative Example 3: Mesh).

Five socks of the present invention were prepared: a sock knit with both a first rib area and a second rib area, with a knitted pile fabric and a knitted mesh fabric alternating every 4 wales (Example 1, mesh: 4 wales, pile: 4 wales); a sock knit with a knitted pile fabric and a knitted mesh fabric alternating every 8 wales (Example 2, mesh: 8 wales; pile: 8 wales); and a sock knit with a knitted pile fabric and a knitted mesh fabric alternating every 12 wales (Example 3, mesh: 12 wales; pile: 12 wales), as well as a sock knit with 4 wales of knitted pile fabric per 12 wales of knitted mesh fabric (Example 4, mesh: 12 wales; pile: 4 wales), and conversely, a sock knit with 12 wales of knitted pile fabric per 4 wales of knitted mesh fabric (Example 5, mesh: 4 wales; pile: 12 wales).

Test Results (Table 1)

TABLE 1 shows the results of permeability tests in the horizontal orientation for Comparative Examples 1-3 and Examples 1-5, using a Frazier permeability tester. The greater the measured value obtained using the Frazier permeability tester, the better was the air permeability in the horizontal orientation.

TABLE 1

Results of Permeability Test in the Horizontal Orientation ($cm^3$/sec)

| | Knitting Structure | Permeability |
|---|---|---|
| Comparative Example 1 | Plain | 0.16 |
| Comparative Example 1 | Pile | 0.40 |
| Comparative Example 3 | Mesh | 0.24 |
| Example 1 | Mesh: 4 wales; Pile: 4 wales | 2.02 |
| Example 2 | Mesh: 8 wales; Pile: 8 wales | 4.60 |
| Example 3 | Mesh: 12 wales; Pile: 12 wales | 5.20 |
| Example 4 | Mesh: 12 wales; Pile: 4 wales | 5.30 |
| Example 5 | Mesh: 4 wales; Pile: 12 wales | 2.02 |

As shown above, Comparative Example 1 (plain), Comparative Example 2 (pile), and Comparative Example 3 (mesh), which are socks with typical knitted structures, have permeability of 0.16-0.4 $cm^3$/sec, while socks of Examples 1-5 of the present invention have permeability of 2.02-5.30 $cm^3$/sec. This confirms that the sock of the present invention has permeability superior to that of the prior art sock.

Making a comparison of the results in relation to the width of the concave portions of the first rib area and the second rib area in Example 1 (4 wales), Example 2 (8 wales), and Example 3 (12 wales), it was found that the greater the width of the concave portion, the greater the permeability, but if it exceeds 8 wales, a dramatic improvement cannot be expected, and the air permeability effect remains about the same. When the design takes into consideration balance with the cushioning effect as well as foot size and its curvature, it is optimal that the convex portions formed by knitted pile fabric and the concave portions formed by knitted mesh fabric alternate with a knitted structure ranging between 4 wales and 8 wales.

Making a comparison of the results in relation to the width ratio of the concave portions and the convex portions of the ribs of the first rib area and the second rib area in Example 2 (1:1), Example 4 (3:1), and Example 5 (1:3), it was found that the greater the ratio of the concave portions, the greater the permeability, but even if the ratio is increased to 1:3, a dramatic improvement cannot be expected, and the air permeability effect remains about the same. When the design takes into consideration balance with the cushioning effect as well as foot size and curvature, the width ratio of the concave portions and the convex portions is optimally 1:1.

(b) Test to Evaluate the In-Shoe Ventilation Rate

The following test method was used to evaluate variations in the in-shoe ventilation environment assumed to occur when the sock is worn with a shoe.

1) Test Method

Two fluorine resin coated tubes were affixed 5 mm apart by means of surgical tape at the bases of the big toe and the second toe on the instep side of a silicone foot model based on a standard adult female, and then a test sock and a shoe were placed on the silicon foot model. Then, $CO_2$ in 10% concentration was injected into a space formed between the surface of the skin at the bases of the toes on the instep side. After 5 minutes, a 2.0 mL gas-tight syringe was used to collect a 0.5 mL sample of $CO_2$ to use as the initial concentration. Then, 30 seconds after the $CO_2$ supply was stopped, a 2.0 mL gas-tight syringe was use to collect another 0.5 mL sample. Gas chromatography was used to determine the $CO_2$ concentrations. Then, the ventilation rate was calculated from these $CO_2$ concentrations, using the formula given below. The greater the measured ventilation rate, the greater the in-shoe ventilation rate.

The ventilation rate was obtained using the ventilation rate formula given in Mathematical Formula 1 below. This formula is based on a report by Uchida et al. "Application of Indoor Ventilation Rate Determination for Measuring Ventilation in Toe Space in a Shoe" appearing in *Shohikagaku* [Journal of the Japan Research Association for Textile End-Use], May 2006 (Vol. 47), p. 63-71.

E: Ventilation rate (times/h)

t: Time (h)

$C_t$: $CO_2$ concentration (%) in toe of shoe after time t $C_0$: Ambient $CO_2$ concentration (%)

$C_1$: Initial $CO_2$ concentration (%) in toe of shoe $$E = 2.303\frac{1}{t}\log\frac{C_1 - C_0}{C_t - C_0}$$ [Mathematical Formula 1]

2) Test Results (Table 2)

Tests were performed to determine the in-shoe ventilation rate for the pile knitted sock of Comparative Example 2, and a sock of the present invention having a structure shown in FIGS. 1-4 (in the first rib area, knitted mesh fabric and knitted pile fabric alternate every 4 wales, and in the second rib area, knitted mesh fabric and knitted pile fabric alternate every 8 wales. The test results below correspond to Example 6.) The results appear in TABLE 2.

TABLE 2

Results of In-Shoe Ventilation Evaluation Tests (times/h)

| | Knitting Structure | Ventilation Rate |
|---|---|---|
| Comparative Example 2 | Pile | 4.20 |
| Example 6 | Mesh: 4-8 wales; Pile: 4-8 wales | 6.40 |

As shown above, the ventilation rate for the sock of Comparative Example 2 (pile) with a typical knitted structure is 4.2 times/h, while the sock of the present invention has a ventilation rate of 6.4 times/h. This confirms that the sock of the present invention exhibits higher in-shoe ventilation performance than the prior art sock, and therefore a superior ventilation effect.

(c) Tests to Measure Bacterial Cell Count and Odor Intensity after 8 Hours of Wearing In order to determine whether or not there is a difference in the degree of performance in humidity prevention in the sock of the present invention in the case where all of the ribs in the first rib area are oriented in the wale direction, and in the case where the ribs are formed diagonally from the arch portion toward the outer side of the little toe at the base of the little toe, tests were performed to measure bacterial cell count and odor intensity after 8 hours of wearing the sock.

1) Test to Measure Bacterial Cell Count

A cotton fabric 3 cm×3 cm was affixed to the base of the small-toe, and a test sock was worn over that. After 8 hours, the cotton fabric was removed and the bacteria were extracted. The bacteria were then grown in a standard culture medium and the colony count was determined.

2) Test to Measure Odor Intensity

After the test sock was worn for 8 hours, it was removed, placed in a covered plastic case and shaken several times, so as to fill the inside of the case with odor. The tip of a New Cosmos XP329N Handy Odor Monitor was inserted into the box to measure the odor intensity.

3) Test Results (Table 3)

Bacterial cell count and odor intensity after 8 hours of wearing were measured for the pile knitted sock of Comparative Example 2, and for the sock of Example 6 in which the ribs of the first ridge area are formed diagonally from the arch portion toward the outer side of the little toe at the base of the little toe, and for the sock of Example 7 in which all of the ribs are disposed in the wale direction. Two adult males were the subjects for these tests.

TABLE 3

Average Cell Count and Average Odor Intensity at the Base of the Little Toe on the Sole Side After 8 Hours of Wearing

| | Knitting Structure | Average Cell Count (number) | Average Odor Intensity (—) |
|---|---|---|---|
| Comparative Example 2 | Pile | 2,339,963 | 598 |
| Example 7 | All ribs of the first rib area are disposed in the wale direction | 1,074,900 | 549 |

TABLE 3-continued

| Average Cell Count and Average Odor Intensity at the Base of the Little Toe on the Sole Side After 8 Hours of Wearing | | | |
|---|---|---|---|
| | Knitting Structure | Average Cell Count (number) | Average Odor Intensity (—) |
| Example 6 | The ribs of the first rib area are disposed diagonally at the base of the little toe | 571,500 | 516 |

As shown above, the average cell count decreases in the following order: Comparative Example 2>Example 7>Example 6. This confirmed that a radial disposition of the ribs in the first rib area is effective in suppressing bacterial growth at the base of the little toe on the sole side. Furthermore, the average odor intensity was also found to decrease in following the order: Comparative Example 2>Example 7>Example 6. This confirmed that a radial disposition of the ribs in the first rib area is also effective in reducing odor on the bottom of the foot.

These results confirm that the sock of the present invention is much more effective in suppressing bacteria growth and odor after wearing it for 8 hours than the prior art sock. In particular, disposing the ribs of the first rib area radially was confirmed to be very effective in inhibiting bacteria and odor.

(d) In-Shoe Simulation Test

Variations in the in-shoe temperature and humidity environment assumed to occur when a sock is worn with a shoe were tested using an in-shoe simulator with a sweat simulator.

1) Test Method

Figure 7:
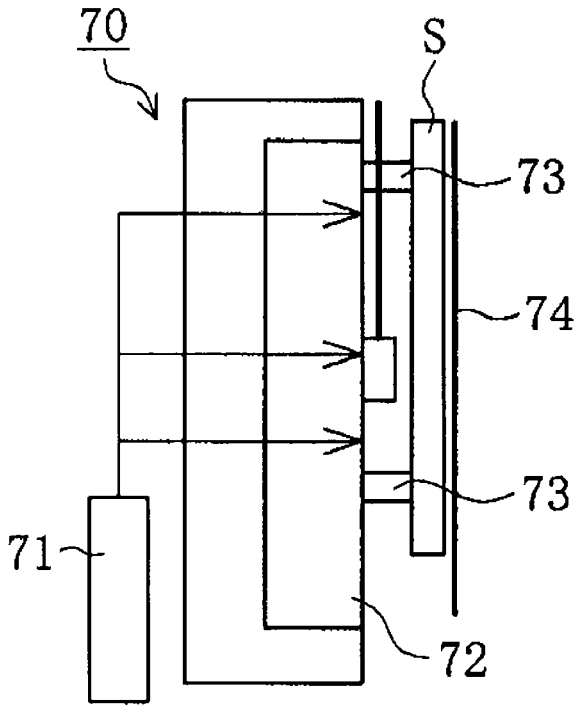
FIG. 7 is a schematic diagram illustrating the construction of a sweat simulator used in testing a sock of the present invention.

FIG. 7 is a schematic diagram illustrating the construction of sweat simulator 70 used in this test. The sweat simulator 70 can be set at any temperature and the amount of sweat thought to occur in the in-shoe environment can be adjusted. 71 is a storage tank for water, 72 is a heating plate, and 73 is a spacer for maintaining a distance of 1.5 cm. The test piece, sock S, was set between a Styrofoam roller 74 and the apparatus, and the temperature and the humidity were measured between the sweat simulator 70 and the sock S.

Measurements were made with the measurement environment at a temperature of 20° C. and a humidity of 65% RH, the temperature of the sweat simulator 70 at 36° C., close to body temperature, and at a sweating rate of 30 mL/m$^2$/hr.

Figure 8A:
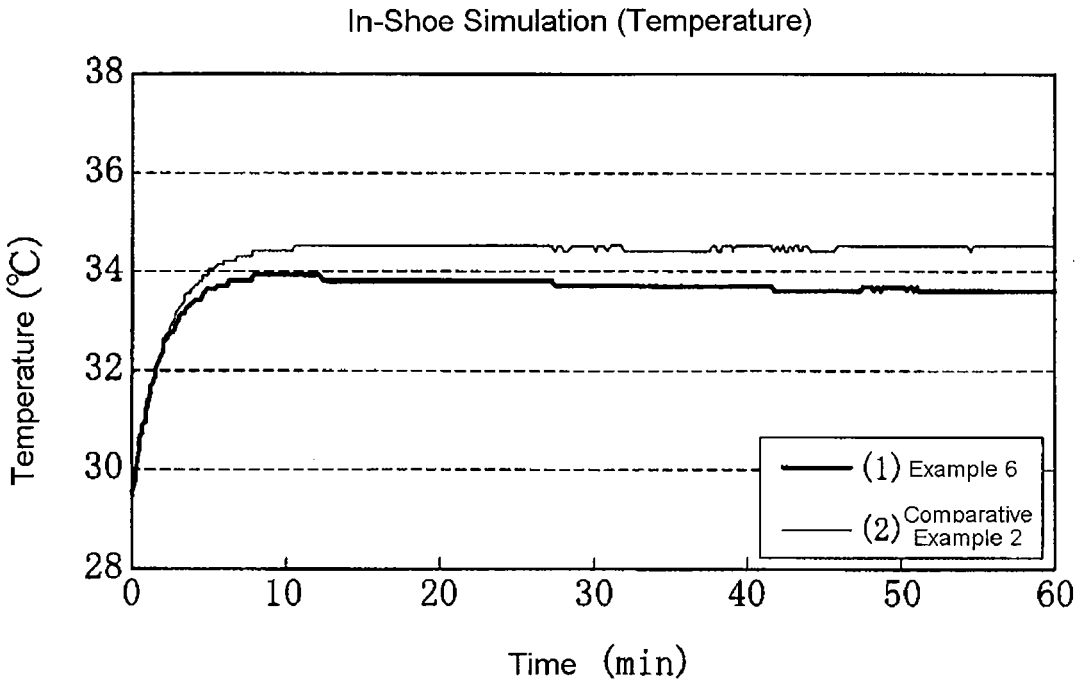
FIG. 8 is a graphical representation of the results of an in-shoe simulation, where (a) shows changes in temperature, and (b) shows changes in humidity.
Figure 8B:
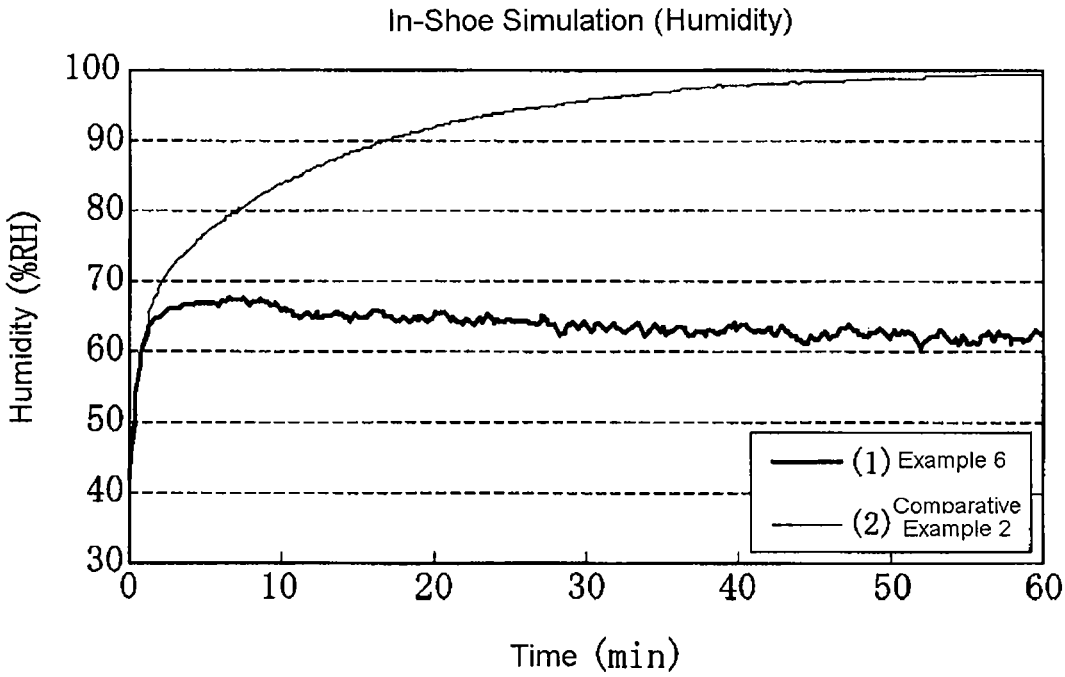

2) Test Results (TABLE 4 and FIG. 8)

In-shoe simulation tests were performed for the sock of Example 6 of the present invention and for the pile knitted sock of Comparative Example 2. The results are given in TABLE 4 and FIG. 8. FIG. 8 shows the test results in the form of a graph, where FIG. 8(*a*) shows changes in temperature and FIG. 8(*b*) shows changes in humidity.

TABLE 4

| In-Shoe Simulation Results | | | | | | |
|---|---|---|---|---|---|---|
| | (1) Example 6 Mesh: 4-8 wales Pile: 4-8 wales | | (2) Comparative Example 2 Pile | | Difference (1) − (2) | |
| Time | Humidity | Temperature | Humidity | Temperature | Humidity | Temperature |
| 0 min | 41.7 | 29.0 | 45.4 | 29.3 | −3.7 | −0.3 |
| After 10 min | 65.9 | 33.9 | 83.9 | 34.4 | −18.0 | −0.5 |
| After 20 min | 65.5 | 33.8 | 92.0 | 34.5 | −26.5 | −0.7 |
| After 30 min | 64.1 | 33.7 | 95.7 | 34.5 | −31.6 | −0.8 |
| After 40 min | 63.5 | 33.7 | 98.0 | 34.5 | −34.5 | −0.8 |
| After 50 min | 62.0 | 33.7 | 98.9 | 34.5 | −36.9 | −0.8 |
| After 60 min | 62.8 | 33.6 | 99.5 | 34.5 | −36.7 | −0.9 |

When a time-course comparison between the temperature and the humidity of the sock of Example 6 of the present invention and the pile knitted sock of Comparative Example 2 was made, there was found to be a difference of only about 3.7% for humidity and 0.3° C. for temperature at the start of the test at 0 min. However, after 10 minutes, the difference grew to 18.0% for humidity and 0.5° C. for temperature; after 30 minutes, the difference grew to 31.6% for humidity and 0.8° C. for temperature; and after 60 minutes, the difference reached 36.7% for humidity and 0.9° C. for temperature. In FIG. 8 as well, and in FIG. 8(*b*) showing changes in humidity in particular, the difference in humidity is found to increase with the passage of time.

These results confirm that the sock of the present invention has a ventilation effect due to the ribs of knitted pile fabric and knitted mesh fabric in the first rib area and in the second rib area, and a suppressing effect on increases in temperature and humidity superior to that of the prior art.

(e) Test to Measure Fabric Air Permeability

Permeability tests were conducted with a KES-F8 permeability tester to determine differences in air permeability due to the knitting structure of 3 types of fabric (Test 1: Plain; Test 2: Pile; Test 3; Mesh). The results are given in TABLE 5.

TABLE 5

| Permeability Test Results (cm$^3$/cm$^2$sec) | | |
|---|---|---|
| | Knitting Structure | Permeability |
| Test 1 | Plain structure | 70 |
| Test 2 | Pile structure | 37 |
| Test 3 | Mesh structure | 152 |

Permeability is remarkably high in Test 3 where a mesh structure was used. The next in order was Test 1 where a plain structure was used, followed by Test 2 where a pile structure was used. Therefore, mesh knitting is used in the present invention to form the concave portions of the ribs forming passageways for humid air. This is because if knitted mesh fabric is used, air can be expected to pass through the knitted mesh fabric to some extent, even when it is still on the way to being expelled to outside of the shoe via the first rib area and the second rib area.

As described above, the sock of the present invention has a first rib area with alternating knitted pile fabric and knitted mesh fabric provided at the ground-touching areas of the sole portion, so that while walking, the humid air which collects in the areas which do not touch the ground, such as the base portion of toes and the arch portion, passes through the concave portions of the first rib area, and is impelled toward the instep side, thereby promoting air permeability. In addition, the instep portion is provided with a second rib area where ribs are formed in the wale direction, being knitted with alternating knitted pile fabric and knitted mesh fabric, so that air which flows to the instep side via the first rib area is expelled to the outside of the shoe via the concave portions of the ribs of the second rib area. Moreover, air from outside of the shoe is introduced into the sock via a route opposite to that described above, whereby the present invention improves the function of ventilation between the inside and the outside of a shoe and has the effect of suppressing increases in temperature and humidity within the sock to the greatest extent possible.

The present invention is not limited to the above examples, and the preferred embodiment can be suitably modified, as long as it is within the scope of the technical ideas recited in the claims. For example, disposition of the ribs in the first rib area is not limited to the example illustrated in FIG. 1, and they may also be provided to the base portion of the big toe 1*a*, the base portion of the little toe 1*b*, and the outside portion of the center of the sole 1*c*, so that the ribs are disposed radially as viewed from the arch portion 3.

The sock of the present invention is not limited to general use, but may also be used as an athletic sock for golf, tennis, jogging, etc.

What is claimed is:

1. A sock comprising:

a first rib area provided in a ground-touching area of a sole portion of the sock in which ribs are formed in a desired direction, which are knitted with alternating knitted pile fabric and knitted mesh fabric; and a second rib area provided in an instep portion in which ribs are formed in a wale direction, which are knitted with alternating knitted pile fabric and knitted mesh fabric, wherein the ribs of the first rib area are provided radially as viewed from an arch portion to the base portion of the big toe, the base portion of the little toe, and the outside portion of the center of the sole.

2. A sock according to claim 1, wherein the ribs of the first rib area are formed only in the portions of base of a big toe, base of a little toe and outside of a center of the sole portion within the ground-touching area of the sole portion.

3. A sock according to claim 1, wherein some of the ribs of the first rib area are formed in a wale direction in the base portion of the big toe, and some of the ribs of the first rib area are formed diagonally from an arch portion toward the outer side of the little toe in the base portion of the little toe.

4. A sock according to claim 3, wherein the sock has an area outside the center of the sole portion in which ribs are formed in a course direction.

5. A sock according to claim 1, wherein the first rib area and the second rib area both have a convex portion formed from knitted pile fabric and a concave portion formed from knitted mesh fabric, with an alternating knitting structure within a range of 4-8 wales.

6. A sock according to claim 1, wherein the first rib area has a knitting structure such that convex portions formed from knitted pile fabric and concave portions formed from knitted mesh fabric alternate every 4 wales, and the second rib area has a knitting structure such that convex portions formed from knitted pile fabric and concave portions formed from knitted mesh fabric alternate every 8 wales.

7. A sock according to claim 1, wherein the second rib area is extended in the wale direction from the instep area to at least a portion of the leg area.

8. A sock according to claim 1, wherein the first rib area and the second rib area are knitted from at least one material selected from polyester, acrylic, wool, rayon and cotton with a high degree of water absorbability and rapid drying properties.

9. A sock according to claim 1, wherein the sock has a heel portion and a toe portion knitted with a knitted pile fabric, and has the arch portion knitted with a knitted mesh fabric.

10. A sock according to claim 1, further comprising a third rib area in which ribs are formed in the wale direction, with pile-knit fabric and mesh-knit fabric knitted in alternating fashion at a position above the heel portion.

11. A sock comprising:

a first rib area provided in a ground-touching area of a sole portion of the sock in which ribs are formed in a desired direction, which are knitted with alternating knitted pile fabric and knitted mesh fabric; and a second rib area provided in an instep portion in which ribs are formed in a wale direction, which are knitted with alternating knitted pile fabric and knitted mesh fabric, wherein the ribs provided in the first rib area and the second area are formed so as to produce concave and convex portions on an inner surface of the sock.

* * * * *

UNITED STATES PATENT AND TRADEMARK OFFICE

CERTIFICATE OF CORRECTION

PATENT NO. : 7,614,257 B2
APPLICATION NO. : 12/246002
DATED : November 10, 2009
INVENTOR(S) : Takahiro Araki et al.

It is certified that error appears in the above-identified patent and that said Letters Patent is hereby corrected as shown below:

On the Title Page

Left column, item (75), replace "Nara" with --Kitakatsuragi-gun-- (both occurrences).

Left column, item (30), add new item as follows:

--Foreign Application Priority Data

(JP) 2007-264871 October 10, 2007--.

Signed and Sealed this

Nineteenth Day of January, 2010

David J. Kappos

David J. Kappos
*Director of the United States Patent and Trademark Office*